United States Patent [19]

Mori et al.

[11] 4,418,765

[45] Dec. 6, 1983

[54] POWER-DRIVEN SCREWDRIVER WITH A TORQUE CONTROL

[75] Inventors: Takashi Mori, Yamatokohriyama; Shuuji Hosokawa, Habikino; Takao Naito, Katano, all of Japan

[73] Assignee: Matsushita Electric Industrial Company, Limited, Osaka, Japan

[21] Appl. No.: 338,996

[22] Filed: Jan. 12, 1982

[30] Foreign Application Priority Data

Jan. 16, 1981 [JP] Japan ..... 56-5279

[51] Int. Cl.[3] ..... B25B 21/00

[52] U.S. Cl. ..... 173/12; 81/470

[58] Field of Search ..... 173/12; 81/469, 470; 73/761

[56] References Cited

U.S. PATENT DOCUMENTS 3,825,912 7/1974 Wiese ..... 73/761 X

FOREIGN PATENT DOCUMENTS 54-36698 3/1979 Japan .

*Primary Examiner*—James M. Meister

*Attorney, Agent, or Firm*—Lowe, King, Price & Becker

[57] ABSTRACT

A screw tightening apparatus comprises a motor-driven screwdriver bit supported on a base for tightening a screw with a torque which is detected as a reactive force acting on the base by a torque detector. An output signal from the torque detector is amplified and delivered to a comparator in which the signal is compared with a signal from a torque setting device which is indicative of a desired torque with which the screw is to be tightened. When the signals agree with each other in the comparator, the latter produces an output signal which is supplied to a switch which in turnde-energizes an electric or pneumatic motor of the screw tightening apparatus. An adjustable time-delay circuit is connected between the comparator and the switch to delay the signal from the comparator for a period of time which may be varied dependent on the material into which the screw is to be driven and the pitch and material of the screw in use. The screwdriver bit is coupled to an output shaft of the motor through an electromagnetic clutch which is de-energizable by the switch simultaneously with the de-energization of the motor.

6 Claims, 2 Drawing Figures

POWER-DRIVEN SCREWDRIVER WITH A TORQUE CONTROL

BACKGROUND OF THE INVENTION

1. Field of the Invention

The present invention relates to a power-driven screw tightening apparatus having a torque control for detecting a screw tightening torque as a reactive force acting on an apparatus base to control the torque with which a screw is to be tightened.

2. Description of Prior Art

Quality control requires that automated screw tightening operation on various products such as industrial machines and electrical household appliances be effected by application of precisely controlled amount of torque dependent for, example, on the material into which screws are to be driven. To meet such precision requirement, there have been proposed and practiced many apparatus for controlling screw tightening torque.

One known torque control for screwdrivers powered by d.c. motors detects a motor armature current and de-energizes the motor for tightening screws with a desired torque when the motor armature current reaches a certain level, the motor armature current being proportional to the load imposed on the motor, or the tightening torque with which the screw is being fastened. When the head of the screw while being tightened engages the material into which the screw is driven, the motor armature is subjected to an abrupt speed reduction, but tends to rotate continuously due to inertia, thus keeping for a moment on producing a torque irrespective of the level of the armature current. At this time, the tightening torque is out of proportion with the armature current, and hence is likely to differ from a desired torque.

Japanese Laid-Open Patent Publication No. 54-36698 discloses a torque control device for power-driven screwdrivers which has a torque detector for detecting a screw tightening torque and a final decision unit for determining whether the torque falls within a predetermined range. With the disclosed arrangement, the tightening torque can be determined only after the screw has been fastened, and it is impossible to prevent screws in advance from being tightened with an excessive torque.

SUMMARY OF THE INVENTION

It is an object of the present invention to provide a power-driven screwdriver for tightening a screw with a precisely controlled amount of torque.

Another object of the present invention is to provide an automatic screw fastener which includes means for de-energizing the drive motor to prevent screws from being fastened too tightly.

Still another object of the present invention is to provide an automatic screw fastener having means for disconnecting a screwdriver bit from the drive shaft when a torque with which a screw is being tightened reaches a selected level.

A further object of the present invention is to provide a screw tightening apparatus having means for adjustably setting periods of time during which screws are to be continuously tightened with a desired torque.

Other objects of the invention include the elimination of the prior disadvantages described above.

According to the present invention, a tightening torque with which a screw is fastened by a screwdriver bit coupled to an electric or pneumatic motor is detected by a torque detector which produces an output signal that is amplified by an amplifier, the output signal of which is compared by a comparator with a torque setting signal from a torque setting device. When the signal from the amplifier is in agreement with the torque setting signal, the comparator issues a signal to a switch, which then de-energizes the motor. An adjustable time-delay circuit is connected between the comparator and the switch to delay the signal supplied from the comparator for a selected interval of time. The screwdriver bit is coupled to an output shaft of the motor through an electromagnetic clutch which is de-energizable by the switch in response to the de-energization of the motor.

BRIEF DESCRIPTION OF THE DRAWINGS

The above and other objects, features and advantages of the present invention will become more apparent from the following description when taken in conjunction with the accompanying drawings in which.

DETAILED DESCRIPTION OF THE PREFERRED EMBODIMENTS

Figure 1:
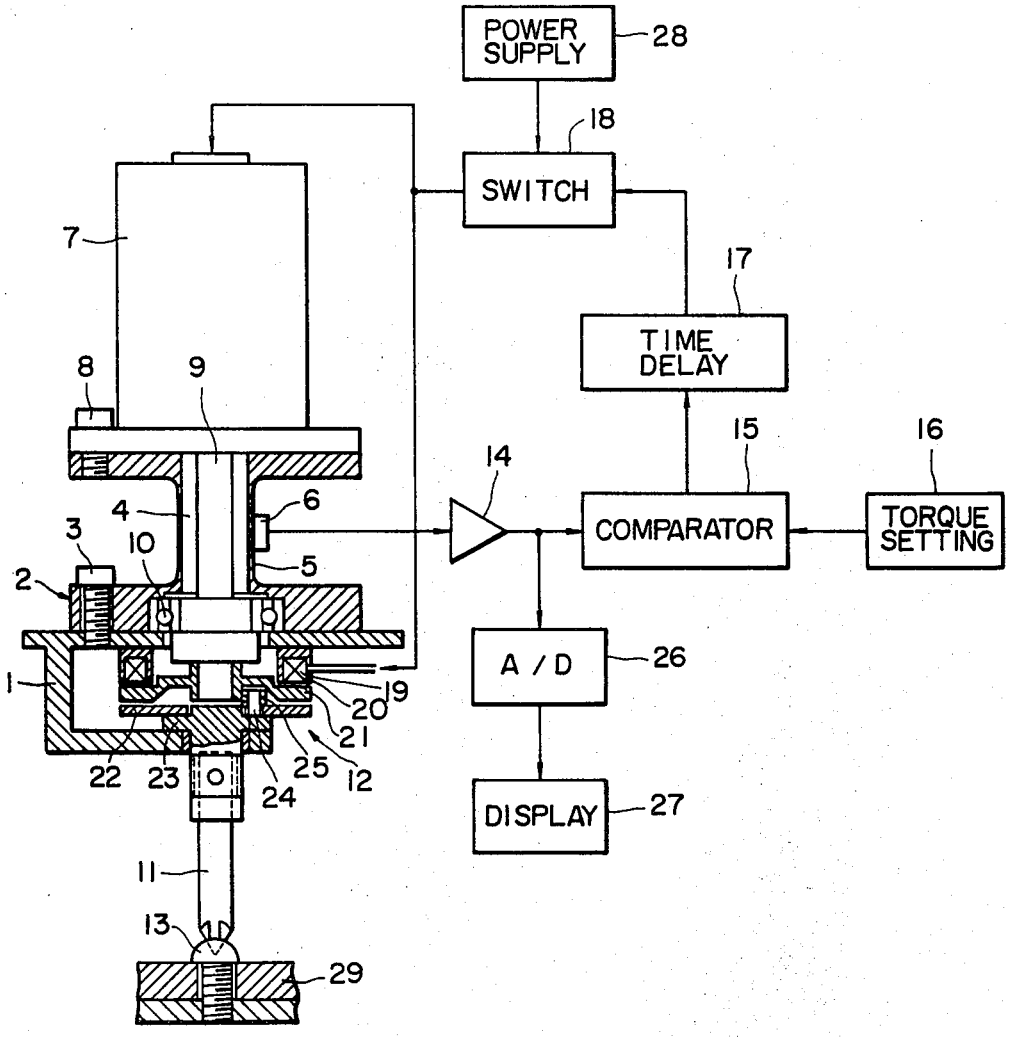
FIG. 1 is a cross-sectional view, partly diagrammatic, of a torque-controlled screw tightening apparatus according to the present invention.

As shown in FIG. 1, a power-driven screwdriver comprises a base 1 on which a torque detector 2 is mounted by screws 3. The torque detector 2 is of a known construction including a central through hole 4 defined by a thin-wall hollow shaft or sleeve 5, and a resistance strain gage 6 attached to an outer peripheral surface thereof. When put under strain or twisting force, the thin-wall sleeve 5 is resiliently deformable relatively easily to enable the strain gage 6 to detect a pressure or distortion which the sleeve 5 undergoes.

An electric motor 7 is mounted coaxially on the torque detector 2 and secured thereto by screws 8. The motor 7 has an output shaft 9 extending concentrically through the hole 4 and rotatably journalled in a bearing 10 mounted in the torque detector 2. A screwdriver bit 11 is rotatably supported on the base 1 in coaxial relation with the motor shaft 9 and coupled thereto through an electromagnetic clutch 12. The electromagnetic clutch 12 includes a field coil 19 constituting a field system 20, a rotor 21 coupled concentrically with the motor shaft 9, and an armature 22 axially movably mounted on a flanged support 23 rotatably mounted on the base 1 and supporting the screwdriver bit 11, the flanged support 23 being axially spaced from the rotor 21. An axial pin 23, secured to the flange of the support 23, extends through the armature 22 toward the rotor 21 and terminates at a point short of distance thereto. A compression coil spring 25 is disposed around and fixed to the pin 24 and normally urges the armature 22 axially away from the rotor 21 toward the support 23. When the field coil 19 is supplied with an electric current, the field system 20 is energized to magnetize the rotor 21, which then attracts the armature 22 into frictional contact therewith, coupling the screwdriver bit 11 with the motor shaft 9 for unitary rotation therewith. Upon de-energization of the field system 20, the armature 22 is forced under the resiliency of the spring 25 to move axially out of contact with the rotor 21, whereupon the screwdriver bit 11 is disconnected from the motor shaft 9.

A torque control circuit illustrated in FIG. 1 comprises an amplifier 14 for amplifying a signal from the resistance strain gage 6, a comparator 15 for generating an output signal when an amplified signal from the amplifier 14 agrees with a signal supplied from a torque setting device 16 and is indicative of a desired torque with which a screw is to be tightened, a time-delay circuit 17 for delaying the signal from the comparator 15, and a switch 18 responsive to a signal from the time-delay circuit 17 for simultaneously de-energizing the motor 7 and the electromagnetic clutch 12. The torque control circuit also includes an analog-to-digital converter 26 for converting the signal from the amplifier 14 into a corresponding digital signal, and a display unit 27 displaying the digital signal which is indicative of the actual torque with which a screw is tightened. An electric power supply 28 is connected to the switch 18 to supply an electric current to the motor 7 and the electromagnetic clutch 12 under the control of the switch 18.

Operation of the power-driven screwdriver thus constructed is as follows: The screwdriver bit 11 is brought into engagement with a screw 13 to be driven into a material 29. The switch 18 is actuated to allow the motor 7 and the electromagnetic clutch 12 to be energized by the power supply 28, whereupon rotative power or tightening torque from the motor 7 is transmitted through the motor shaft 9, the electromagnetic clutch 12, and through the screwdriver bit 11 to the screw 13. The tightening torque is applied as a reactive force to the torque detector 2, causing the thin-wall sleeve 5 to be twisted or distorted. The twisted distortion of the thin-wall sleeve 5 in turn causes the resistance strain gage 6 to change its electrical resistance and produce a signal proportional to such change in resistance. The signal from the strain gage 6 is fed through the amplifier 14 to the comparator 15. When the signal from the amplifier 14 is within a range defined by the torque setting signal from the torque setting device 16, the comparator 15 issues an output signal which is delivered to the switch 18 upon elapse of a period of time determined by the time-delay circuit 17. The switch 18 is responsive to a supplied signal to cut off the electric current from the power supply 28 to the motor 7 and the electromagnetic clutch 12. Therefore, the motor 7 and the electromagnetic clutch 12 are de-energized simultaneously to complete tightening of the screw 13 with a desired torque which is established by the torque setting device 16. Simultaneous de-energization of the electromagnetic clutch 12 and the motor 7 permits the screwdriver bit 11 to discontinue its rotation at the instant the switch 18 is opened, without being subjected to inertia which would otherwise tend to cause the motor 7 and its output shaft 9 to rotate the screwdriver bit 11 even after de-energization of the motor 7.

The tightening torque is generated after the head of the screw 13 engages the surface of the material 29. The period of time required to reach a stable tightening torque after the screw head has seated on the material 29 depends on the pitch of the screw 13, the rate of elongation of the screw 13 which varies from material to material, and the rate of contraction of the material 29. For example, the tightening time may be relatively small when hard material such as metal is to be fastened together. A longer tightening time is needed to fasten resilient material such as synthetic resin or rubber packings. Stated otherwise, the resilient objects can be fastened precisely together by holding them for a certain period of time until the elongation of the screw and the contraction of the objects are stabilized. To meet such differing times of tightening operation, the time-delay circuit 17 is adjustable so that it can delay the signal from the comparator 15 to keep the motor 7 and the electromagnetic clutch 12 energized for a selected period of time after a desired screw tightening torque has been reached. Thus, effective and precise screw tightening can be effected by adjusting the time-delay circuit 17 dependent on the material of the screw 13 used and the material of the objects to be fastened with the screw 13.

Figure 2:
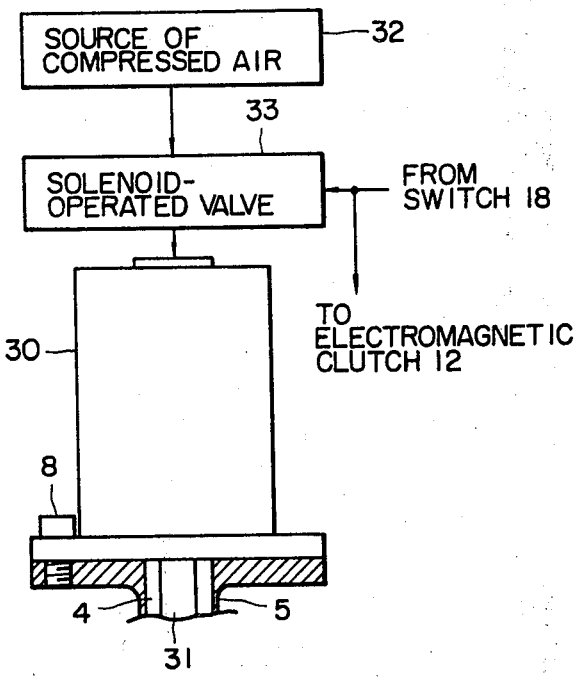
FIG. 2 is a fragmentary view, partly diagrammatic, of a screw tightening apparatus according to another embodiment of the present invention.

FIG. 2 illustrates a power-driven screwdriver according to another embodiment of the present invention. The screwdriver is powered by a pneumatic motor 30 supplied with air under pressure from a source of compressed air 32 such as an air compressor through a solenoid-operated valve 33 which is controlled by the switch 18. When a signal from the time-delayed circuit 17 is applied to the switch 18, the switch 18 de-energizes the solenoid-operated valve 33 to stop the pneumatic motor 30 and at the same time de-energizes the electromagnetic clutch 12.

Although certain preferred embodiments have been shown and described in detail, it should be understood that many changes and modifications may be made therein without departing from the scope of the appended claims.

What is claimed is:

1. A power-driven screwdriver comprising:

a base;

a motor mounted on said base;

a screwdriver bit mounted on said base and rotatably drivable by said motor to tighten a screw with a tightening torque;

a torque detector mounted on said base for producing a signal representative of said tightening torque;

a torque setting device for generating a signal indicative of a desired tightening torque with which the screw is to be tightened;

a comparator for generating a comparator output signal when said torque representative signal is within a range defined by the signal from said torque setting device;

a switch responsive to said comparator output signal for de-energizing said motor; and a time-delay circuit interposed between said comparator and said switch for introducing a delay time to said comparator output signal applied to said switch.

2. A power-driven screwdriver according to claim 1, said motor having an output shaft, further including an electromagnetic clutch coupled between said output shaft and said screwdriver bit and de-energizable by said switch to disconnect said screwdriver bit from said output shaft simultaneously with the de-energization of said motor.

3. A power-driven screwdriver according to claim 2, said motor comprising an electric motor, further including an electric power supply connected through said switch to said electric motor and said electromagnetic clutch.

4. A power-driven screwdriver according to claim 2, said motor comprising a pneumtic actuator, further including a source of compressed air connected to said pneumatic actuator and a solenoid-operated valve interposed between said source of compressed air and said pneumatic actuator and de-energizable by said switch.

5. A power-driven screwdriver according to claim 1, including an analog-to-digital converter for converting said torque representative signal into a digital signal, and a display unit for displaying said digital signal.

6. A power-driven screwdriver according to claim 1, said time-delay circuit being adjustable to vary said delay time.

* * * * *